United States Patent [19]

Karnofsky et al.

[11] 4,276,021

[45] Jun. 30, 1981

[54] METHOD OF RECOVERING HEAT FROM HOT GRANULAR SOLIDS

[75] Inventors: George B. Karnofsky, Pittsburgh; Robert E. Brink, Sewickley, both of Pa.

[73] Assignee: Dravo Corporation, Pittsburgh, Pa.

[21] Appl. No.: 64,800

[22] Filed: Aug. 8, 1979

[51] Int. Cl.[3] ..... F27D 15/02

[52] U.S. Cl. ..... 432/85; 165/DIG. 12; 165/DIG. 27; 208/11 LE; 122/28

[58] Field of Search ..... 165/107, DIG. 12; 432/85; 208/11 LE; 122/28

[56] References Cited

U.S. PATENT DOCUMENTS

| | | | |
|---|---|---|---|
| 1,089,110 | 3/1914 | Chappell | 432/85 |
| 1,447,593 | 3/1923 | Macklind | 432/85 |
| 2,903,407 | 9/1959 | Fischer et al. | 208/11 LE |
| 4,197,183 | 4/1980 | Audeh | 208/11 LE |

*Primary Examiner*—Albert W. Davis

*Attorney, Agent, or Firm*—Parmelee, Miller, Welsh & Kratz

[57] ABSTRACT

A continuous process for heating a fluid by recovering heat from a heated, pumpable aqueous slurry of granular material wherein the slurry is passed through an indirect heat exchanger to heat the fluid and then passed to a second indirect heat exchanger to preheat water for forming of further heated, pumpable slurry, with the slurry next passed to a third indirect heat exchanger to heat makeup water to the system and then to a thickener wherein the granular material is separated and the water recovered from the thickener is returned to the system.

5 Claims, 1 Drawing Figure

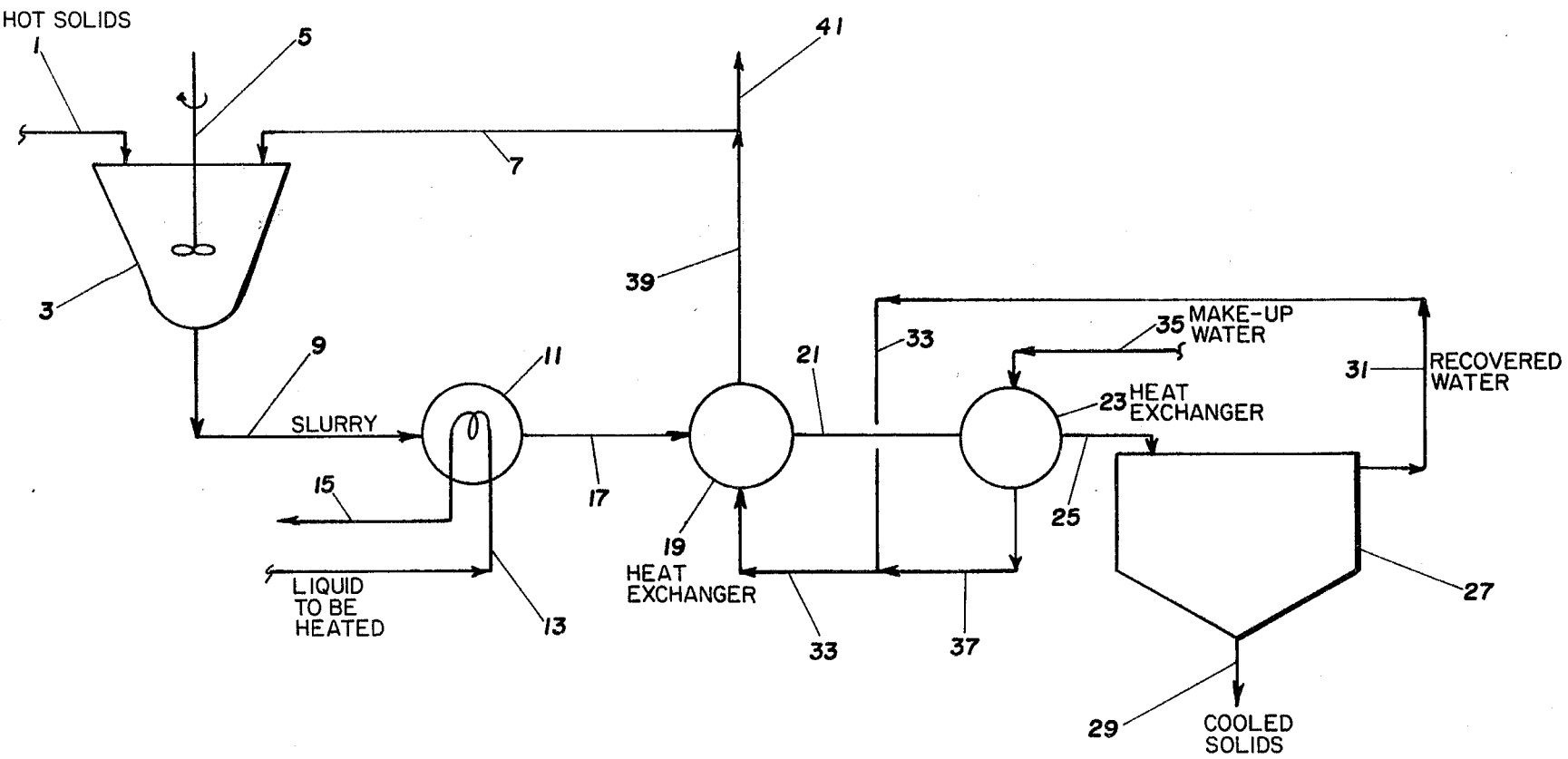
HOT SOLIDS
1
3
5
7
9
SLURRY
11
13
LIQUID TO BE HEATED
15
17
19
HEAT EXCHANGER
21
23
HEAT EXCHANGER
25
27
29
COOLED SOLIDS
31
RECOVERED WATER
33
33
35
MAKE-UP WATER
37
39
41

METHOD OF RECOVERING HEAT FROM HOT GRANULAR SOLIDS

BACKGROUND OF THE INVENTION

The present invention is concerned with the recovery of heat from hot granular solids, such as sand. In chemical processing, numerous processes exist wherein a granular material, such as sand, is heated during the processing and, with the present day energy requirements, efforts need to be made to recover heat from such solids prior to their discharge from a system.

For example, in the processing of bitumen containing oil sands, such as by solvent extraction, large quantities of hot sand are discharged from the extraction system. Recovery of heat from such solids is important in providing an economical and energy-efficient system. Such heat may, for example, be used to heat the process streams or solvents used in the extraction of the oil from the sand, or in other steps of the process.

An example of a system wherein the present process is especially useful is the process for extraction of bitumen from oil-bearing sand described in copending application Ser. No. 41,769 filed May 23, 1979 in the name of George B. Karnofsky, one of the present inventors, entitled "Method of and Apparatus for the Continuous Solvent Extraction of Bitumen from Oil-Bearing Sand," and assigned to the assignee of the present invention, the contents of said application being incorporated by reference herein. In the process described in said copending application, the hot, wet bitumen free sand, prior to discarding, is processed to recover the heat therefrom, the recovered heat used to heat the sand slurry that is to be subjected to extraction and oil separation to the desired process temperature.

Other uses of the present heat recovery process would, of course, be known to those skilled in the art relating to processing of hot granular materials that can be formed into a pumpable slurry.

BRIEF SUMMARY OF THE INVENTION

A continuous process for heating a fluid by recovering heat from a hot granular material, such as sand, that can form a pumpable aqueous slurry, comprises mixing the hot sand with preheated water to form a pumpable slurry, passing the slurry through an indirect heat exchanger to heat the fluid and then passing the slurry to a second indirect heat exchanger to preheat water for mixing with further hot sand in the continuous process. The slurry is then passed to a third indirect heat exchanger, where makeup water for use in the process is heated, and thence to a thickener. The thickener separates water from the slurry for recovery while the cooled sand is discharged. Recovered water from the thickener is mixed with the makeup water that has been passed through the third heat exchanger and the combined stream preheated in the second indirect exchanger by heat transfer with slurry. The preheated water is then introduced into the mixer where further pumpable aqueous slurry is formed from hot sand from continuous processing.

BRIEF DESCRIPTION OF THE DRAWING

The drawing is a schematic illustration of the process of the present invention wherein heat is recovered from a hot granular material.

DETAILED DESCRIPTION

In the present process, heat is recovered from hot granular material, which heat is used to elevate the temperature of a fluid such as a solvent. The hot granular material must be of a type that can be formed into a pumpable slurry, and not incompatible with water, which is used in the formation of the slurry. A granular material to which the present process is especially suited is sand, although other granular materials may be treated. The fluid that is to be heated by recovery of heat according to the present process may be a gas, a liquid, or even a slurry, and would be dependent upon the desired use for the recovered heat. For brevity, the following description will refer to hot solids as hot sand and the fluid to be heated as a liquid, although the process is applicable to recovery of heat from other hot granular materials and to the heating of any fluid or slurry.

Referring now to the drawing, a hot granular material, such as sand, which can be formed into a pumpable aqueous slurry is introduced through line 1 into a mixer 3 which has an agitation means such as a stirrer 5. The hot granular material is mixed in mixer 3 with preheated water introduced thereto through line 7, this water being preheated as hereinafter described.

The hot aqueous pumpable sand slurry is discharged from mixer 3 through line 9 and is passed through an indirect heat exchanger 11 in heat exchange relation to the liquid that is to be heated, which liquid is introduced into the indirect heat exchanger 11 through line 13 and, after being heated therein, is carried by line 15 for use, as desired, in heated condition. After passage through the heat exchanger 11, the aqueous sand slurry, which is now partially cooled, flows through line 17 to a second indirect heat exchanger 19, wherein water that is to be preheated for use in forming further aqueous sand slurry is heated, as later described. From the second indirect heat exchanger 19, the aqueous sand slurry which has now been further cooled flows through line 21 to a third heat exchanger 23 where makeup water for the system is heated.

Slurry that is discharged from the third heat exchanger 23 flows through line 25 to a thickener 27. In the thickener, the cooled aqueous slurry is separated into sand which is discharged from the thickener 27 through line 29 and water which is recovered for use in the system. Recovered water from the thickener 27 is carried by line 31 back to the system by means of line 33.

The recovered water from line 33 is passed through the second indirect heat exchanger 19 and is heated by hot aqueous sand slurry passing through said heat exchanger. Also added to the line 33 is makeup water for use in the system. Makeup water, from a source not shown, is passed by means of line 35 through the third indirect heat exchanger 23 and is heated therein by the slurry. This initially heated makeup water then flows through line 37 to combine with the recovered water in line 33. The combined recovered water and initially heated makeup water in line 33 pass through the second indirect heat exchanger 19 and is further heated by the hot aqueous sand slurry passing through said heat exchanger. From the second indirect heat exchanger 19, the combined recovered water and makeup water flow through line 39 and to line 7, through which the preheated water is charged to the mixer 3 for formation of additional hot aqueous sand slurry. If desired, a portion of the preheated water from line 39 may be bled from the system through line 41 for use elsewhere.

As an example of the recovery of heat from hot sand, wherein parts are parts by weight, to heat a feed slurry of oil-sand and miscella, for use in a process for extraction of bitumen from the oil sand, the extracted sand which is fed to a residue stripper contains 90 parts of sand, 9 parts of a solvent and 7.7 parts of water. Water is recycled to the extracted sand through line 41 in an amount of 3 parts to assure that the sand is not dusty. Condensation of water in the residue stripper, in which steam is in direct contact with the sand, will provide an additional 2.3 parts of water. Consequently, 90 parts sand and 13 parts water at 212° F. leave the residue stripper and heat therefrom is recovered as follows.

The 90 parts hot sand and 13 parts water is slurried with 77 parts of water (preheated to 125° F.) so as to form a hot, pumpable aqueous sand slurry at a temperature of 150° F. This slurry is passed to the first indirect heat exchanger where heat is indirectly transferred to a feed slurry containing 90 parts oil-bearing sand, 110 parts miscella and 5 parts water. That feed slurry is heated from 114° F. to 134.1° F. while the aqueous sand slurry is cooled from 150° F. to 135.5° F. for a net heat recovery of 1,570 BTU. The sand slurry is then passed to the second heat exchanger where it is further cooled to 124.4° F. by indirect heat transfer to 80 parts of water. The temperature of the water flowing through the second indirect heat exchanger is increased from 110° F. to 125° F. Of this preheated water, 77 parts is returned to the mixer for formation of additional aqueous sand slurry. The remaining 3 parts is recycled to the residue stripper. The sand slurry then passes to the third indirect heat exchanger where it is further cooled to 110° F. by indirect heat transfer to 20 parts of makeup water entering the heat exchanger at 32° F. The sand slurry is introduced into the thickener at 110° F. and separated. Discharged from the thickener as bottoms is 30 parts water and 90 parts sand at 110° F., while the remaining 60 pounds water at 110° F. overflows to the second heat exchanger, after combination with the preheated makeup water.

Although the heat exchangers shown on the drawing may be of any suitable type, they are preferably of the so-called spiral interchanger type, in which the two streams between which heat is interchanged follow countercurrent spiral paths separated by heat transfer surfaces. In this type of heat exchanger, either or both streams may be slurries.

In the practice of the present process it is important that the recovered water from the thickener and the makeup water, prior to being mixed for introduction into the second heat exchanger, be at about the same temperature so as to minimize the loss of potential for heat transfer.

What is claimed is:

1. In a continuous process for the recovery of heat from a hot granular material, capable of being formed into a pumpable slurry, so as to heat a fluid, the improvement comprising:

mixing the hot granular material with preheated water to form an aqueous, heated, pumpable slurry;

passing said slurry through a first indirect heat exchanger in heat exchange relation with the fluid to be heated so as to heat the latter and partially cool said slurry;

passing said partially cooled slurry from said first indirect heat exchanger to a second indirect heat exchanger in heat exchange relation with water to preheat said water for use in said mixing and further cool said slurry;

transferring said further cooled slurry from said second indirect heat exchanger to a thickener wherein water is recovered from said slurry;

adding makeup water to said recovered water; and recycling said recovered water from the thickener and said makeup water for use as water to be preheated in the second indirect heat exchanger.

2. In a continuous process for recovery of heat from hot granular material as defined in claim 1, the improvement wherein said slurry, after passage through said second indirect heat exchanger and prior to transfer to said thickener, is passed through a third indirect heat exchanger in heat exchange relation with said makeup water to heat the makeup water prior to addition to said recovered water.

3. In a continuous process for recovery of heat from hot granular material as defined in claim 1, the improvement wherein said hot granular material is sand.

4. In a continuous process for the recovery of heat from hot sand, so as to heat a fluid, the improvement comprising:

mixing the hot sand with preheated water to form a heated, pumpable aqueous sand slurry;

passing said aqueous sand slurry through a first indirect heat exchanger in heat exchange relation with the fluid to be heated so as to heat the latter and partially cool said aqueous sand slurry;

passing said partially cooled aqueous sand slurry from said first indirect heat exchanger to a second indirect heat exchanger in heat exchange relation with water to preheat said water for use in said mixing with additional hot sand and further cool said aqueous sand slurry;

passing said further cooled aqueous and slurry from said second indirect heat exchanger to a third indirect heat exchanger in heat exchange relation with makeup water to be mixed with said water to be preheated;

transferring the aqueous sand slurry from said third indirect heat exchanger to a thickener wherein water is recovered from said slurry; and recycling said recovered water from the thickener for use as water to be preheated in the second indirect heat exchanger along with the preheated makeup water, for use in said mixing with additional hot sand.

5. In a continuous process for recovery of heat from hot sand as defined in claim 4, the improvement wherein said hot sand comprises spent sand resulting from solvent extraction of a feed slurry of oil bearing said and miscella followed by stream stripping of the sand residue, and wherein said fluid comprises further said feed slurry.

* * * * *